US007416459B1

(12) United States Patent
Pelini

(10) Patent No.: US 7,416,459 B1
(45) Date of Patent: Aug. 26, 2008

(54) JACK PLATE/HYDRAULIC CYLINDER SYSTEM

(76) Inventor: Mark F. Pelini, 406 Sonoma Dr., Valrico, FL (US) 33594

( * ) Notice: Subject to any disclaimer, the term of this patent is extended or adjusted under 35 U.S.C. 154(b) by 0 days.

(21) Appl. No.: 11/787,386

(22) Filed: Apr. 16, 2007

(51) Int. Cl.
*B63H 5/125* (2006.01)

(52) U.S. Cl. ..... 440/61 R

(58) Field of Classification Search ..... 440/61 R
See application file for complete search history.

(56) References Cited

U.S. PATENT DOCUMENTS

| | | | | |
|---|---|---|---|---|
| 4,461,486 | A | 7/1984 | Tregonning | |
| 5,193,821 | A * | 3/1993 | Rehfeld | 277/468 |
| 5,299,489 | A * | 4/1994 | Obrecht et al. | 92/5 R |
| 5,718,613 | A | 2/1998 | Nakamura | |
| 5,782,662 | A | 7/1998 | Icenogle | |
| 5,984,741 | A | 11/1999 | Nakamura | |
| 6,176,170 | B1 | 1/2001 | Uppgard | |
| 6,409,556 | B1 | 6/2002 | Vance | |

* cited by examiner

*Primary Examiner*—Stephen Avila
(74) *Attorney, Agent, or Firm*—Edward P. Dutkiewicz

(57) ABSTRACT

A cylinder is adjustably positionable between a jack plate and a fixed transom bar. A housing has an upper end, a lower end, a bottom cap and a top cap. The housing includes a piston. The piston is axially slidable within the cylinder. The piston has a rod. The rod is coupled to the piston. A bore is provided through the upper cap for the passage of the rod. A fluid handling assembly includes a lower port and an upper port. The lower port extends through the housing adjacent to the lower end. The upper port extends through the housing adjacent to the upper end. A pair of annular recess is provided in the piston. An o-ring and a rectangular ring are provided within each recess. A pair of annular recesses is provided in the upper and lower caps. An o-ring and a rectangular ring are provided within each recess.

1 Claim, 3 Drawing Sheets

FIG 1
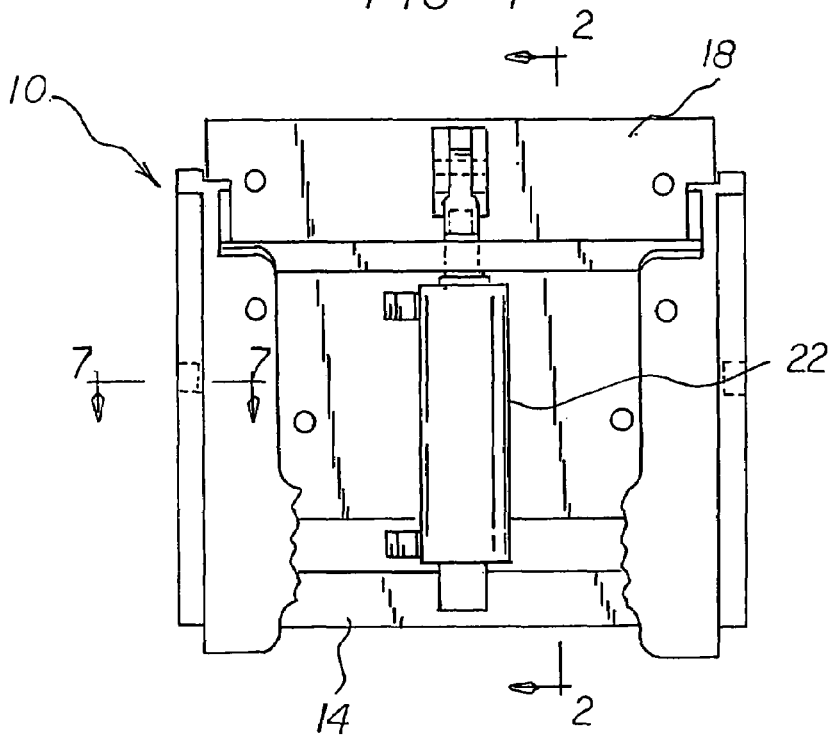
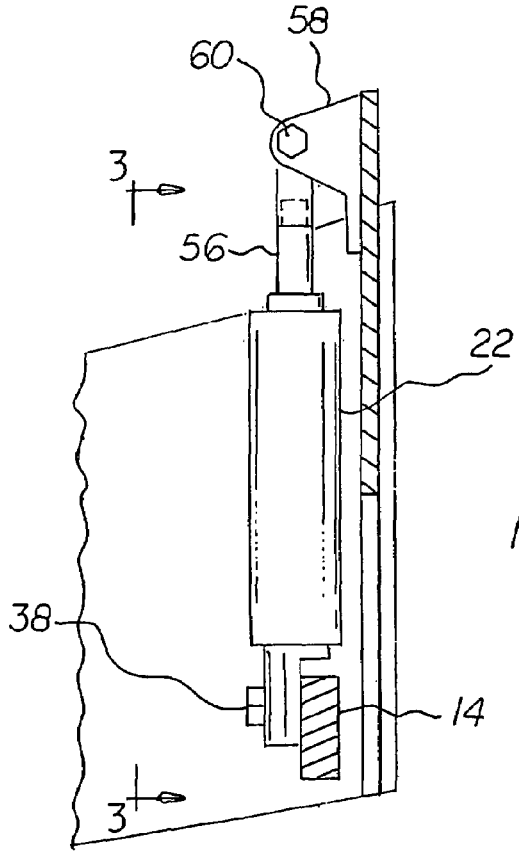
FIG 2

JACK PLATE/HYDRAULIC CYLINDER SYSTEM

BACKGROUND OF THE INVENTION

1. Field of the Invention

The present invention relates to a jack plate/hydraulic cylinder system and more particularly pertains to the vertical adjustable coupling of an outboard motor with respect to a boat in a safe, secure and economical manner.

2. Description of the Prior Art

The use of hydraulic systems of known designs and configurations is known in the prior art. More specifically, hydraulic systems of known designs and configurations previously devised and utilized for the purpose of vertical adjustment through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 6,409,556 issued Jun. 25, 2002 to Vance relates to a Variable Height Outboard Motor Mount Apparatus. U.S. Pat. No. 6,176,170 issued Jan. 23, 2001 to Uppgard relates to a Hydraulic Actuator with Shock Absorbing Capability. U.S. Pat. No. 5,984,741 issued Nov. 16, 1999 to Nakamura relates to a Hydraulic Tilt and Trim Control for Marine propulsion. U.S. Pat. No. 5,782,662 issued Jul. 21, 1998 to Icenogle relates to a Hydraulic Marine Jack Plate. U.S. Pat. No. 5,718,613 issued Feb. 17, 1998 to Nakamura relates to a Marine Hydraulic Tilt and Trim Control. Lastly, U.S. Pat. No. 4,461,486 issued Jul. 24, 1984 to Tregonning relates to a Piston Rod Scraper and Breather Assembly.

While these devices fulfill their respective, particular objectives and requirements, the aforementioned patents do not describe a jack plate/hydraulic cylinder system that allows for the vertical adjustable coupling of an outboard motor with respect to a boat, all in a safe and secure and economical manner.

In this respect, the jack plate/hydraulic cylinder system according to the present invention substantially departs from the conventional concepts and designs of the prior art, and in doing so provides an apparatus primarily developed for the purpose of the vertical adjustable coupling of an outboard motor with respect to a boat, all in a safe and secure and economical manner.

Therefore, it can be appreciated that there exists a continuing need for a new and improved jack plate/hydraulic cylinder system which can be used for the vertical adjustable coupling of an outboard motor with respect to a boat in a safe, secure and economical manner. In this regard, the present invention substantially fulfills this need.

SUMMARY OF THE INVENTION

In view of the foregoing disadvantages inherent in the known types of hydraulic systems of known designs and configurations now present in the prior art, the present invention provides an improved jack plate/hydraulic cylinder system. As such, the general purpose of the present invention, which will be described subsequently in greater detail, is to provide a new and improved jack plate/hydraulic cylinder system and method which has all the advantages of the prior art and none of the disadvantages.

To attain this, the present invention essentially comprises a jack plate/hydraulic cylinder system. First provided is a laterally extending fixed transom bar. The fixed transom bar is fixedly positioned at the rear of a boat.

Provided next is a jack plate. The jack plate is adjustably positioned at the rear of a boat. The jack plate is adapted to support an outboard motor.

Further provided is a hydraulic cylinder. The hydraulic cylinder is adjustably coupled above to the jack plate. The hydraulic cylinder is adjustably coupled below to the fixed transom bar. The hydraulic cylinder includes a hollow cylindrical housing. The housing has an upper end and a lower end. The housing has a cylindrical chamber.

The housing has a bottom cap. The bottom cap has an upper end. The upper end is positioned within the lower end of the housing. The bottom cap has a lower end. The bottom cap has a flat face. The housing has a bolt. The bolt secures the bottom cap to the fixed transom bar.

The housing has a top cap. The top cap has a lower end. The lower end is positioned within the upper end of the housing. The top cap has an upper end. The upper end is provided exterior of the housing. A lower split ring is provided. The lower split ring secures the bottom cap to the housing. An upper split ring is also provided. The upper split ring secures the top cap to the housing. The hydraulic cylinder also includes a cylindrical piston. The piston is axially slidable within the housing between the top and bottom caps. The piston includes a rod. The rod has a bottom end. The bottom end is coupled to the piston. The rod has an upper end. The upper end is coupled to the jack plate. A clevis and bolt are between the rod and the jack plate. The rod has a central extent. A bore is provided. The bore is provided through the upper cap. In this manner passage of the rod is allowed.

Provided last is a fluid handling assembly. The fluid handling assembly includes a lower recess. The lower recess is formed in the lower cap facing the piston. The fluid handling assembly includes an upper recess. The upper recess is formed in the upper cap facing the piston.

The fluid handling assembly includes a lower port. The lower port extends through the housing adjacent to the lower end and into the lower recess.

The fluid handling assembly includes an upper port. The upper port extends through the housing adjacent to the upper end and into the upper recess. A pair of annular recesses is provided in the piston. An o-ring and a rectangular ring are provided within each recess. A pair of annular recesses is provided in the lower cap. The annual recesses span the lower port. An o-ring and a rectangular ring are provided within each recess. A pair of annular recesses is provided in the upper cap. The annual recesses span the upper port. O-rings and a rectangular ring are provided within each recess. The rectangular rings are preferably fabricated of nitrile 90 durometer packing rings. A single annular recesses is provided in the upper end of the upper cap facing the rod. Three o-rings are provided within the recess. An annular recess is provided adjacent each end of the cylinder. An o-ring is provided between an associated end and split ring. The lower port is adapted to input hydraulic fluid. In this manner the piston and jack plate may be raised while the upper port is outputting hydraulic fluid. The upper port is adapted to input hydraulic fluid. In this manner the piston and jack plate may be lowered while the lower port is outputting hydraulic fluid.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jack plate/hydraulic cylinder system which has all of the advantages of the prior art hydraulic systems of known designs and configurations and none of the disadvantages.

It is another object of the present invention to provide a new and improved jack plate/hydraulic cylinder system which may be easily and efficiently manufactured and marketed.

It is further object of the present invention to provide a new and improved jack plate/hydraulic cylinder system which is of durable and reliable constructions.

An even further object of the present invention is to provide a new and improved jack plate/hydraulic cylinder system which is susceptible of a low cost of manufacture with regard to both materials and labor, and which accordingly is then susceptible of low prices of sale to the consuming public, thereby making such jack plate/hydraulic cylinder system economically available to the buying public.

Even still another object of the present invention is to provide a jack plate/hydraulic cylinder system for the vertical adjustable coupling of an outboard motor with respect to a boat in a safe, secure and economical manner.

Lastly, it is an object of the present invention to provide a new and improved jack plate/hydraulic cylinder system. A cylinder is adjustably positionable between a jack plate and a fixed transom bar. A housing has an upper end, a lower end, a bottom cap and a top cap. The housing includes a piston. The piston is axially slidable within the cylinder. The piston has a rod. The rod is coupled to the piston. A bore is provided through the upper cap for the passage of the rod. A fluid handling assembly includes a lower port and an upper port. The lower port extends through the housing adjacent to the lower end. The upper port extends through the housing adjacent to the upper end. A pair of annular recess is provided in the piston. An o-ring and a rectangular ring are provided within each recess. A pair of annular recesses is provided in the upper and lower caps. An o-ring and a rectangular ring are provided within each recess.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a jack plate/hydraulic cylinder system constructed in accordance with the principles of the present invention.

FIG. 2 is a side elevational view of the system taken along line 2-2 of FIG. 1.

The same reference numerals refer to the same parts throughout the various Figures.

DESCRIPTION OF THE PREFERRED EMBODIMENT

Figure 3:
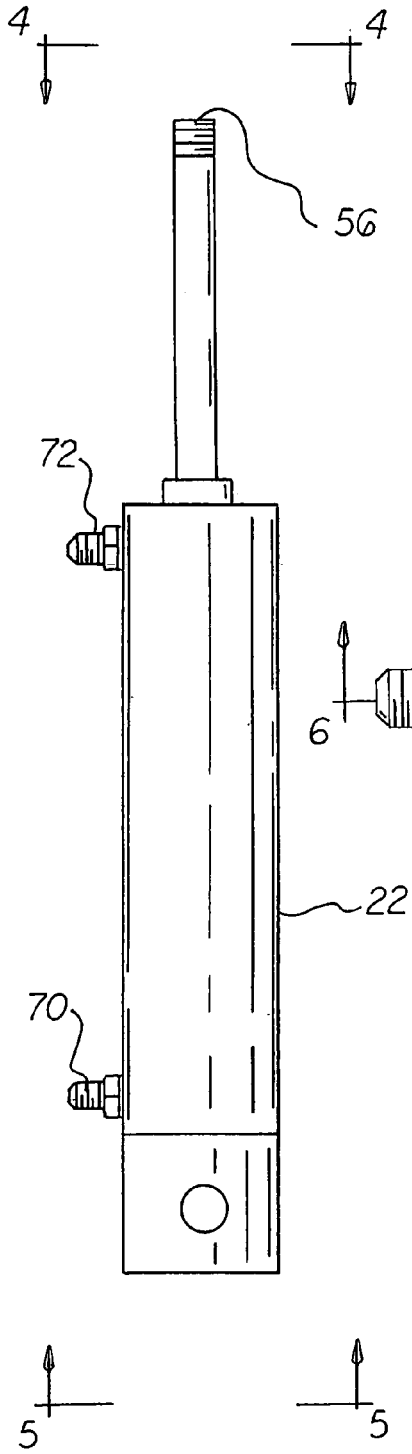
FIG. 3 is a front elevational view of the hydraulic cylinder taken along line 3-3 of FIG. 2.
Figure 4:
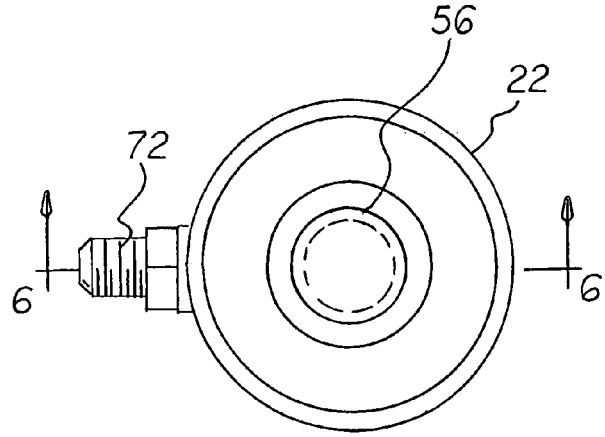
FIG. 4 is a plan view of the hydraulic cylinder taken along line 4-4 of FIG. 3.
Figure 5:
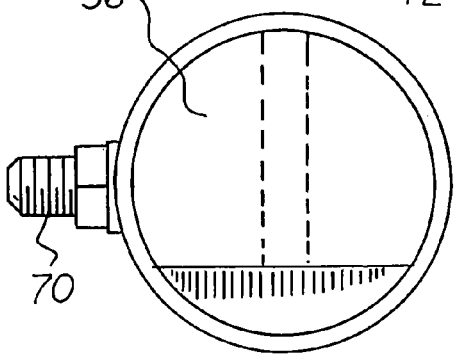
FIG. 5 is a bottom view of the hydraulic cylinder taken along line 5-5 of FIG. 3.

With reference now to the drawings, and in particular to FIG. 1 thereof, the preferred embodiment of the new and improved jack plate/hydraulic cylinder system embodying the principles and concepts of the present invention and generally designated by the reference numeral 10 will be described.

The present invention, the jack plate/hydraulic cylinder system 10 is comprised of a plurality of components. Such components in their broadest context include a cylinder and a fluid handling assembly. Such components are individually configured and correlated with respect to each other so as to attain the desired objective.

First provided is a laterally extending fixed transom bar 14. The fixed transom bar is fixedly positioned at the rear of a boat.

Provided next is a jack plate 18. The jack plate is adjustably positioned at the rear of a boat. The jack plate is adapted to support an outboard motor.

Further provided is a hydraulic cylinder 22. The hydraulic cylinder is adjustably coupled above to the jack plate. The hydraulic cylinder is adjustably coupled below to the fixed transom bar. The hydraulic cylinder includes a hollow cylindrical housing 24. The housing has an upper end 26 and a lower end 28. The housing has a cylindrical chamber 30.

The housing has a bottom cap 32. The bottom cap has an upper end 34. The upper end is positioned within the lower end of the housing. The bottom cap has a lower end 36. The bottom cap has a flat face. The housing has a bolt 38. The bolt secures the bottom cap to the fixed transom bar.

The housing has a top cap 40. The top cap has a lower end 42. The lower end is positioned within the upper end of the housing. The top cap has an upper end 44. The upper end is provided exterior of the housing. A lower split ring 46 is provided. The lower split ring secures the bottom cap to the housing. An upper split ring 48 is also provided. The upper split ring secures the top cap to the housing. The hydraulic cylinder also includes a cylindrical piston 50. The piston is axially slidable within the housing between the top and bottom caps. The piston includes a rod 52. The rod has a bottom end 54. The bottom end is coupled to the piston. The rod has an upper end 56. The upper end is coupled to the jack plate. A clevis 58 and bolt 60 are between the rod and the jack plate. The rod has a central extent. A bore 62 is provided. The bore is provided through the upper cap. In this manner passage of the rod is allowed.

Provided last is a fluid handling assembly. The fluid handling assembly includes a lower recess 66. The lower recess is formed in the lower cap facing the piston. The fluid handling assembly includes an upper recess 68. The upper recess is formed in the upper cap facing the piston.

The fluid handling assembly includes a lower port 70. The lower port extends through the housing adjacent to the lower end and into the lower recess.

The fluid handling assembly includes an upper port 72. The upper port extends through the housing adjacent to the upper end and into the upper recess. A pair of annular recesses 74 is provided in the piston. An o-ring 76 and a rectangular ring 78 are provided within each recess. A pair of annular recesses 80 is provided in the lower cap. The annual recesses span the lower port. An o-ring 82 and a rectangular ring 84 are provided within each recess. A pair of annular recesses 86 is provided in the upper cap. The annual recesses span the upper port. O-rings 88 and a rectangular ring 90 are provided within each recess. A single annular recesses 92 is provided in the upper end of the upper cap facing the rod. Three o-rings 94 are provided within the recess. An annular recess 96 is provided adjacent each end of the cylinder. An o-ring 98 is provided between an associated end and split ring.

The o-rings are essentially conventional rings with a circular cross sectional configuration. The rectangular rings are rings with a rectangular cross sectional configuration having, when not under stress, parallel flat surfaces contacting the faces being sealed. The rectangular rings are preferably fabricated of nitrile 90 durometer material. The preferred rectangular rings are Parbak™ packing back up rings, nitrile 90 durometer packing rings. Parbak is a trademark of Parker Hahnifin Customer Support Inc. Corporation of Cleveland, Ohio. Such rings are designed for service in petroleum based fluids at minus 40 degrees Celsius to 121 degrees Celsius. The standard Parbak N1444-90 compounds are nitrile 90 durometer.

The lower port is adapted to input hydraulic fluid. In this manner the piston and jack plate may be raised while the upper port is outputting hydraulic fluid. The upper port is adapted to input hydraulic fluid. In this manner the piston and jack plate may be lowered while the lower port is outputting hydraulic fluid.

Figure 7:
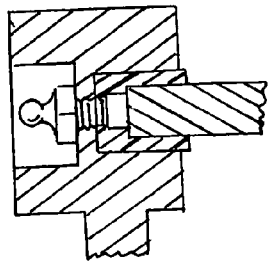
FIG. 7 is a cross sectional view taken along line 7-7 of FIG. 1.
Figure 6:
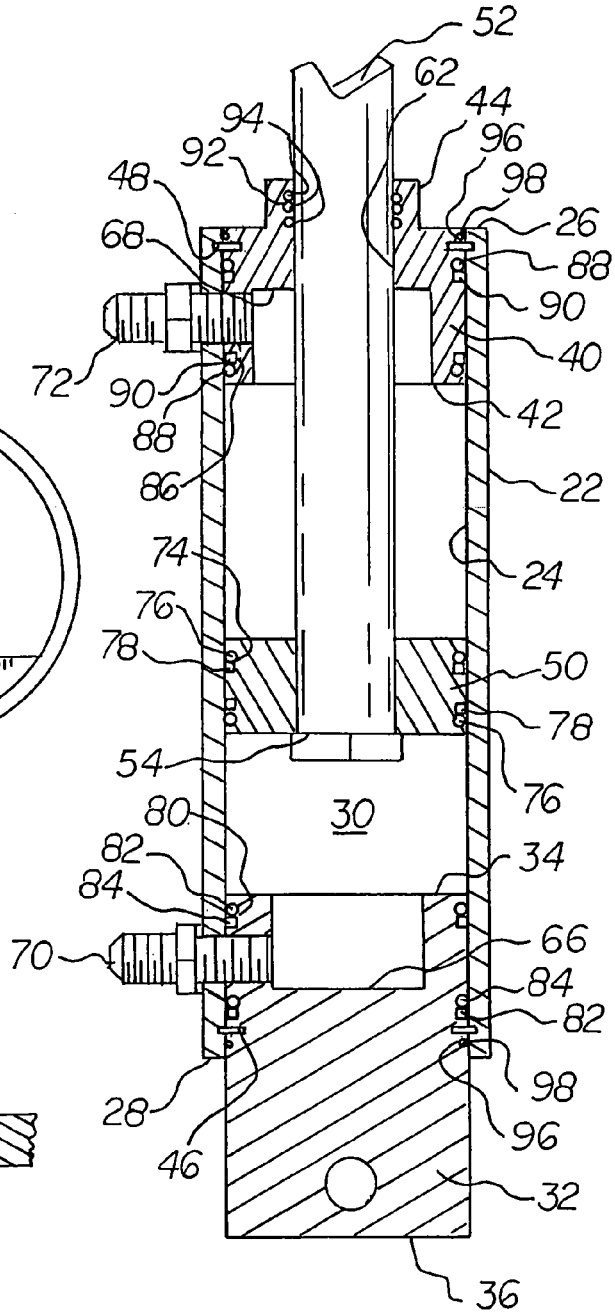
FIG. 6 is a cross sectional view of the hydraulic cylinder taken along line 6-6 of FIG. 4.

FIG. 7 is a cross sectional view taken along line 7-7 of FIG. 1. Such Figure illustrates one of the grease fittings. One grease filling is installed on each side of the jack plate. The grease fittings keep the bearing area along each lateral edge of the jack plate properly lubricated during operation and use.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jack plate/hydraulic cylinder system for the vertical adjustable coupling of an outboard motor with respect to a boat in a safe, secure and economical manner comprising, in combination:

a laterally extending fixed transom bat fixedly positioned at the rear of a boat;

a jack plate adjustably positioned at the rear of a boat and adapted to support an outboard motor;

a hydraulic cylinder adjustably coupled above to the jack plate and below to the fixed transom bar, the hydraulic cylinder including a hollow cylindrical housing with an upper end and a lower end and a cylindrical chamber there within, a bottom cap having an upper end positioned within the lower end of the housing and a lower end with a flat face and a bolt securing the bottom cap to the fixed transom bar, a top cap having a lower end positioned within the upper end of the housing and an upper end exterior of the housing, a lower split ring securing the bottom cap to the housing and an upper split ring securing the top cap to the housing, the hydraulic cylinder also including a cylindrical piston axially slidable within the housing between the top and bottom caps, the piston including a rod with a bottom end coupled to the piston and an upper end coupled to the jack plate with a clevis and bolt between the rod and the jack plate, the rod having a central extent with a bore through the upper cap for the passage of the rod; and a fluid handling assembly including a lower recess formed in the lower cap facing the piston and an upper recess formed in the upper cap facing the piston with a lower port extending through the housing adjacent to the lower end and into the lower recess and an upper port extending through the housing adjacent to the upper end and into the upper recess, the fluid handling assembly including a pair of annular recesses in the piston with an o-ring and a rectangular ring within each recess, a pair of annular recesses in the lower cap spanning the lower port with an o-ring and a rectangular ring within each recess, a pair of annular recesses in the upper cap spanning the upper port with o-rings and a rectangular ring within each recess, the rectangular rings being fabricated of nitrile 90 durometer packing rings, a single annular recesses in the upper end of the upper cap facing the rod with three o-rings within the recess, an annular recess adjacent each end of the cylinder with an o-ring between an associated end and split ring, the lower port adapted to input hydraulic fluid for raising the piston and jack plate while the upper port is outputting hydraulic fluid, the upper port adapted to input hydraulic fluid for lowering the piston and jack plate while the lower port is outputting hydraulic fluid.

* * * * *